US009044974B1

(12) United States Patent
Mo

(10) Patent No.: US 9,044,974 B1
(45) Date of Patent: Jun. 2, 2015

(54) SYSTEM AND METHOD FOR ONLINE WEB CONTROL IN A TANDEM WEB PRINTING SYSTEM

(71) Applicant: Xerox Corporation, Norwalk, CT (US)

(72) Inventor: Song-Feng Mo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/182,890

(22) Filed: Feb. 18, 2014

(51) Int. Cl.
*B41J 15/04* (2006.01)
*B41J 13/00* (2006.01)
*B41J 15/00* (2006.01)

(52) U.S. Cl.
CPC ..... *B41J 15/04* (2013.01); *B41J 13/0009* (2013.01); *B41J 15/005* (2013.01)

(58) Field of Classification Search
CPC ..... B41J 15/005
See application file for complete search history.

(56) References Cited

U.S. PATENT DOCUMENTS

| | | | | |
|---|---|---|---|---|
| 5,274,242 | A | 12/1993 | Dragon et al. | |
| 5,402,957 | A | 4/1995 | Evans | |
| 5,847,742 | A * | 12/1998 | Nishimura | 347/173 |
| 6,285,850 | B1 | 9/2001 | Van Weverberg et al. | |
| 6,297,886 | B1 | 10/2001 | Cornell | |
| 6,363,228 | B1 | 3/2002 | Ream | |
| 6,476,923 | B1 | 11/2002 | Cornell | |
| 6,567,621 | B2 | 5/2003 | Miyoshi et al. | |
| 6,799,507 | B2 * | 10/2004 | Ohba et al. | 101/228 |
| 6,914,619 | B2 | 7/2005 | Koide | |
| 7,038,808 | B2 | 5/2006 | Yamakado et al. | |
| 7,427,061 | B2 | 9/2008 | Ruthenberg et al. | |
| 7,581,727 | B2 | 9/2009 | Iesaki | |
| 7,665,817 | B2 | 2/2010 | Folkins | |
| 8,131,173 | B2 | 3/2012 | Noguchi et al. | |
| 8,529,007 | B2 | 9/2013 | Folkins et al. | |
| 2009/0086221 | A1 | 4/2009 | Silverbrook et al. | |
| 2010/0194028 | A1 | 8/2010 | Frisque | |
| 2011/0199414 | A1 | 8/2011 | Lang | |
| 2011/0203472 | A1 | 8/2011 | Shin et al. | |
| 2011/0280638 | A1 | 11/2011 | Eun | |
| 2012/0312855 | A1 * | 12/2012 | Horaguchi | 226/1 |
| 2013/0233191 | A1 * | 9/2013 | Mo et al. | 101/490 |

* cited by examiner

*Primary Examiner* — Shelby Fidler
(74) *Attorney, Agent, or Firm* — Maginot Moore & Beck LLP

(57) ABSTRACT

A tandem printing system for imaging a media web includes a first and second print engines. A controller identifies a change in a position over time of a bottom of the media web in a loop box that is placed in the media path between the first and second print engines. The controller identifies an effective diameter of a drive roller in one of the print engines with reference to the change in position of the bottom of the media web. The controller modifies a rotational velocity of the drive roller with reference to the effective diameter to maintain velocity of the media web at a predetermined level and control a position of the bottom of the media web in the loop box.

20 Claims, 5 Drawing Sheets

SYSTEM AND METHOD FOR ONLINE WEB CONTROL IN A TANDEM WEB PRINTING SYSTEM

TECHNICAL FIELD

This disclosure relates generally to a tandem printing system for imaging a media web, and, more particularly, to methods for controlling velocity of a media web that moves between two print engines.

BACKGROUND

Inkjet printers operate a plurality of inkjets in each printhead to eject liquid ink onto an image receiving surface. In a tandem inkjet printing system, two different inkjet printing engines form printed patterns on a print medium, such as media pulled from a supply roll or other print medium. In some configurations, the tandem print engines form printed images on opposite sides of the print medium for duplex printing, while in other configurations an upstream tandem print engine forms a first printed image or portion of a printed image while a downstream tandem print engine forms another image or portion of an image over the images from the upstream print engine. In either configuration, the print engines move the print medium past inkjet printheads in separate print zones to form the printed images. The quality of printed images in the tandem printing configuration can be affected by comparatively small variations in the velocity of the print medium. Larger variations in the velocity of the print medium can result in registration errors where ink drops from different inkjet printheads in the print zone land in incorrect locations and fail to produce printed images having appropriate image quality. Consequently, the media transport devices in the tandem printer attempt to minimize changes to the velocity of the media web during the printing to maintain the quality of printed images.

In addition to controlling the velocity of the print medium, the tandem printing system includes a loop box that maintains a predetermined level of the position of the media web in the loop box. The loop box includes a vacuum in the base of the loop box or a payload weigh that increases or decreases the position of the bottom of the media web in the loop box as needed by increasing or decreasing the media web speed in either upstream engine or downstream engine. The limited range of motion for the bottom of the media web in the loop box can limit the effectiveness of the loop box in situations where a persistent difference in the velocity of the print medium persists through the upstream print engine and the downstream print engine. For example, if the velocity of the print medium through the upstream print engine is consistently higher than the downstream print engine, the print medium eventually goes slack between the two print engines. In another situation, if the velocity in the downstream print engine is consistently higher than the velocity in the upstream print engine, then the print medium experiences gradually increasing the bottom of the media web in the loop box and the media web eventually breaks.

Comparatively small differences in the velocity of the print medium between the upstream and downstream print engines can eventually overwhelm the loop box and require printer shutdown to adjust the media web. One source of velocity variation is due to the varying thicknesses of different types of print media that engage drive rollers and other rollers in the media transport paths of the upstream and downstream print engines. Varying thicknesses of different types of paper have a small but measurable effect on the velocity of the media web in different sections of the tandem printing system.

Additionally, even a single type of paper with a predetermined thickness can experience shrinkage, stretching, or other types of deformation that change the effective thickness of the paper in the printing system. Existing solutions that compensate for the thickness variations of different types of print media require a calibration process that is performed using the same type of paper before a printing operation can commence using the selected paper. The calibration operation consumes time and renders a portion of the print medium unsuitable for printing. Consequently, improvements to the operation of tandem printing systems that enable operation with a wide range of print media types without requiring offline calibration would be beneficial.

SUMMARY

In one embodiment, a method of operating a printer for tandem printing has been developed. The method includes operating with a controller at least one actuator operatively connected to a roller in a first print engine, the roller engaging a media web and the at least one actuator rotating the roller at a first rotational velocity to move the media web in a process direction through the first print engine and through a loop box configured maintain a position of the media web within a predetermined range of positions in the loop box, identifying with the controller a first position of a bottom of the media web at a first time with reference to a signal from a position sensor operatively connected to the bottom of the media web, identifying with the controller a second position of the bottom of the media web at a second time occurring after the first time with reference to another signal from the position sensor, identifying with the controller an elapsed time corresponding to a time period between the first time and the second time, implementing with the controller a loop feedback controller for adjusting the rotational velocity of the roller, identifying with the controller a total accumulative position change of the bottom of the media web due to adjustment of the rotational velocity of the roller from the loop feedback controller between the first time and the second time, identifying with the controller a change in position of the bottom of the media web corresponding to a difference between the second position, the first position of the, and the total accumulative position change due to the loop feedback controller, identifying with the controller an effective diameter of the roller that engages the media web with reference to the elapsed time, the change in position of the bottom of the media web, a predetermined diameter of the roller when not in engagement with the media web, and the first rotational velocity of the roller, and operating with the controller the at least one actuator to rotate the roller at a second rotational velocity corresponding to a predetermined linear velocity with reference to the effective diameter of the roller and the loop feedback controller.

In another embodiment, a printing system has been developed. The printing system includes a roller in a first print engine configured to engage a media web, at least one actuator operatively connected to the roller and configured to rotate the roller to move the media web in a process direction, a loop box configured to engage the media web to enable a bottom of the media web in the loop box to move between a first position and a second position, a loop box sensor configured to identify a position of the bottom of the media web in the loop box, and a controller operatively connected to the roller, the at least one actuator, and the loop box sensor. The controller is configured to operate the at least one actuator to rotate the roller at a first rotational velocity to move the media web in a process direction through the first print engine and through the loop box, identify a first position of the bottom of the media web in the loop box at a first time, identify a second position of the bottom of the media web at a second time occurring after the first time, identify an elapsed time corresponding to a time period between the first time and the second time, execute stored program instructions to implement a loop feedback controller for adjusting the rotational velocity of the roller, identify a total accumulative position change of the bottom of the media web due to adjustment of the rotational velocity of the roller from the loop feedback controller between the first time and the second time, identify a change in position of the bottom of the media web corresponding to a difference between the second position, the first position of the, and the total accumulative position change due to the loop feedback control, identify an effective diameter of the roller that engages the media web with reference to the elapsed time, the change in the position of the bottom of the media web, a predetermined diameter of the roller when not in engagement with the media web, and the first rotational velocity of the roller, and operate the at least one actuator to rotate the roller at a second rotational velocity corresponding to a predetermined linear velocity with reference to the effective diameter of the roller and the loop feedback controller.

BRIEF DESCRIPTION OF THE DRAWINGS

The foregoing aspects and other features of a tandem printing system that identifies an effective diameter of a drive roller to operate with improved velocity control in a tandem printer is explained in the following description, taken in connection with the accompanying drawings.

DETAILED DESCRIPTION

Figure 1:
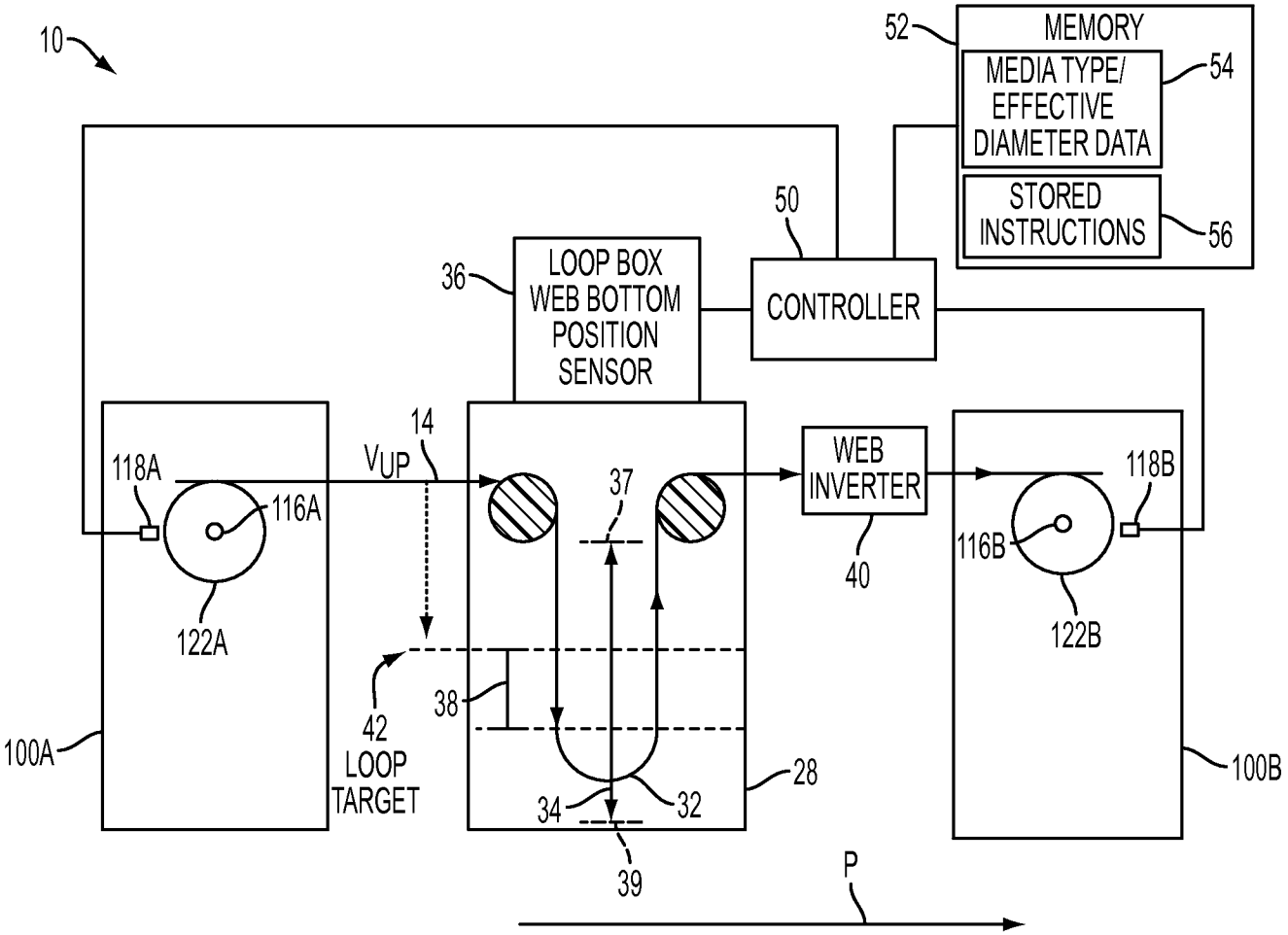
FIG. 1 is a schematic diagram of a tandem printing system that includes two print engines and a loop box configured to move a media web through the tandem printing system.

For a general understanding of the environment for the system and method disclosed herein as well as the details for the system and method, reference is made to the drawings. In the drawings, like reference numerals have been used throughout to designate like elements. As used herein the term "printer" and "printing apparatus", which may be used interchangeably, refer to any device that produces ink images on media and includes, but is not limited to, photocopiers, facsimile machines, multifunction devices, as well as direct and indirect inkjet printers. As used herein, the term "print engine" refers to a device in a printing system that includes a marking unit and a media transport that moves a print medium past the marking unit to form printed images on the print medium. In an inkjet printing system, a print engine includes one or more printheads arranged in a print zone that eject ink drops onto a print medium, such as an elongated media web, and one or more rollers and actuators in the print engine move the media web in a process direction. In some embodiments, a print engine can be operated as a standalone printer, while in other embodiments a print engine is a component in a larger printing system.

As described below, a tandem printing system includes multiple print engines. An image receiving surface refers to any surface that receives ink drops, such as an imaging drum, imaging belt, or various recording media including paper. Furthermore, as used herein, the term "tandem printing system" refers to a system in which two or more printers or print engines are configured serially to enable web media to pass through the printers along a contiguous path so the media web media printed by one printer may be subsequently printed upon by another printer with accurate registration of images.

As used herein, the term "media web" refers to an elongated print medium that passes through one or more print engines in a printing system to receive printed images. A common example of a media web is an elongated roll of paper that unwinds along a media path through one or more print engines. The media often passes through one or more print engines and other assemblies in a print system in a serpentine path with the forward direction of movement corresponding to the process direction in different sections of the printing system. The path can loosely resemble a spider web, and the terms media web and web printing system are used to describe the configuration of the print medium and the print engines that use the media web. In a tandem printing configuration, the paper roll passes through an upstream print engine for first-side printing, a loop box device that maintains an appropriate level of tension on the media web, an inverter that flips the media web, and a downstream print engine that prints on a second side of the media web. After printing the media web is rewound into a roll for additional processing, or is optionally fed to a finishing device that cuts the media web into individually printed sheets and performs other media processing functions.

As used herein, the term "process direction" refers to a direction of movement of an image receiving member, such as a media web, through one or more print engines in a printing system. As used herein, the term "upstream" refers to a direction of movement against the process direction and to a location along a media path that the print medium passes prior to reaching another "downstream" location. Similarly, the term "downstream" refers to a direction of movement of the print medium along the process direction and to a location along the media path that a print medium passes after passing another upstream location on the media path.

FIG. 1 depicts a schematic diagram of a tandem printing system 10. The printing system 10 includes an upstream print engine 100A that receives a media web 14, a loop box 28 including a bottom of the media web 32, web inverter 40, downstream print engine 100B, a controller 50, and a memory 52. In the illustrative embodiment of FIG. 1, the media web 14 is an elongated roll of paper or another suitable elongated print medium that forms a media web through the tandem printing system 10. As is known in the art, a wide range of paper types that include different thicknesses, propensities to shrink during printing, ink absorption characteristics, and other physical properties are available for use in tandem printing systems.

The print engines 100A and 100B each include a media transport that moves the media web 14 in the process direction P. Each print engine includes at least one drive roller which is operatively connected to an actuator, such as an electric motor, to rotate the drive roller. The media web 14 engages the drive roller in each print engine and moves in the process direction at a rate corresponding to a linear velocity of each drive roller. Each drive roller is operatively connected to a rotational sensor, such as a Hall Effect sensor or other suitable sensor, which generates a signal corresponding to a measured rotational velocity of the drive roller. Some embodiments of the print engines 100A and 100B include other rollers that guide and support the media web 14 as the media web 14 moves past inkjet printheads or other marking devices in each print engine. In the simplified diagram of FIG. 1, the print engines 100A and 100B include actuators 116A and 116B, rotational sensors 118A and 118B, and drive rollers 122A and 122B, respectively.

In the tandem printing system 10, the loop box 28 is positioned downstream from the upstream print engine 100A and upstream from the downstream print engine 100B. The loop box 28 includes the repositionable bottom of the media web 32 that moves along the axis 34 in the illustrative example of FIG. 1. The media web 14 passes through the loop box 28 with a curved "U" or "V" shape configuration as depicted in FIG. 1. In some embodiments, the base of the loop box 28 includes a vacuum suction device that pulls the media web 14 downward into the curved shape depicted in FIG. 1. In other embodiments, a payload weight (not shown) places a downward force on the media web 14. The media web 14 passes through the loop box 28 after passing through the upstream print engine 100A before exiting the loop box 28 and moving through the downstream print engine 100B. A consistent difference in the velocity of the media web between the upstream print engine 100A and the downstream print engine 100B causes the media web to slack or touch the ground if the speed of the print engine 100A is greater than that of the print engine 100B. If the media web velocity in the downstream print engine 100B is greater than the media web velocity in the print engine 100A, the media web 14 can experience excess tension that can warp or tear the media web 14.

To account for variations in the velocity of the media web 14, The controller 50 adjusts the process direction velocity of either upstream print engine 100A or downstream print engine 100B to maintain the position of the media web 14 within the loop box 28 along the axis 34 between stop positions 37 and 39. The stop positions 37 and 39 depict the maximum range of the media web motion for the bottom of the media web 32 in the loop box 28. The distance between the stop positions 37 and 39 varies with the physical dimensions of different loop box embodiments, and is approximately 500 millimeters in one embodiment. During operation, the controller 50 in the printing system controls the linear velocity of the media web 14 through the upstream print engine 100A and downstream print engine 100B to enable the bottom of the media web 32 to remain comparatively close to a "target" position 42 in the loop box 28. Typically, the target position 42 in the embodiment of FIG. 1 lies halfway between the stop positions 37 and 39 along the axis 34.

In the loop box 28, the loop box position sensor 36 generates a signal that corresponds to the position of the bottom of the media web 32 along the axis 34 in the loop box 28. In one embodiment, the loop box position sensor 36 includes a series of optical sensors that are arranged along the axis 34 to identify the location of the bottom of the media web 32 as the bottom of the media web 32 moves along the axis 34. As the bottom of the media web 32 moves along the axis, the media web 14 interrupts a beam of light between an emitter and receiver in some of the optical sensors. The position of the bottom of the media web 14 between the stop positions 37 and 39 is identified based on the predetermined locations of optical sensors that transmit uninterrupted light beams and the optical sensors where the media web 14 interrupts the light beams. The controller 50 is operatively connected to the loop box position sensor 36 to identify the location of the bottom of the media web 32 in the loop box 28 and to identify a distance between the bottom of the media web 32 and the target position 42. The distance between the bottom of the media web 32 and the target position 42 is also referred to as a position error of the loop box. As described below, the controller 50 adjusts the rotational velocity of a drive roller in one of the print engines 100A and 100B to account for small velocity errors that gradually produce large position errors of the bottom of the media web 32 to enable the bottom of the media web 32 to remain at or near the target position 42 during operation.

In the tandem printing system 10, the media web inverter 40 receives the media web 14 and flips or "inverts" the media web so that a second side of the media web passes through the print zone in the downstream print engine 100B. The media web inverter 40 enables duplex printing where the first print engine 100A prints on a first side of the media web 14 and the second print engine 100B prints on a second side of the media web. While the media web inverter 40 is depicted downstream from the loop box 28 in FIG. 1, the media web inverter 40 is positioned between the upstream print engine 100A and the loop box 28 in another embodiment. In still another embodiment, the inverter 40 is omitted in tandem printing systems that use two print engines to form printed images on a single side of the media web 14.

Operation and control of the various subsystems, components and functions of the printer 5 are performed with the aid of the controller 50. The controller 50 is implemented with general or specialized programmable processors that execute programmed instructions. The instructions and data required to perform the programmed functions are held as stored instructions 56 in a memory 52 that is operatively connected to the controller 50. The stored instructions 56 include parameters for a feed-forward controller that adjusts the acceleration of the media web 14 through one of the print engines 100A and 100B while the media web accelerates to an operating process direction velocity. The stored instructions 56 also include parameters for a loop feedback controller that adjusts the velocity of the media web through one of the print engines 100A and 100B once the media web 14 reaches a predetermined operating velocity to maintain the position of the bottom of the media web 32 in the loop box 28 at or near the target position 42. In the embodiment of FIG. 1, the memory 52 also stores data 54 corresponding to different types of print media in association with the effective diameter of a drive roller in the print engines 100A and 100B when using the print media. The stored media type and effective roller diameter data 54 can be used to provide an initial estimate for the effective diameter of a drive roller, such as rollers 122A and 122B, during a print job that uses a print medium that has previously been employed in the printing system 10.

The memory 52 includes volatile data storage devices such as random access memory (RAM) and non-volatile data storage devices including magnetic and optical disks or solid state storage devices. The processors, their memories, and interface circuitry configure the controllers and/or print engine to perform the functions, such as the difference minimization function, described above. These components are provided on a printed circuit card or provided as a circuit in an application specific integrated circuit (ASIC). In one embodiment, each of the circuits is implemented with a separate processor device. Alternatively, the circuits can be implemented with discrete components or circuits provided in VLSI circuits. Also, the circuits described herein can be implemented with a combination of processors, ASICs, discrete components, or VLSI circuits.

In the configuration of FIG. 1, the controller 50 is operatively connected to the drive roller actuators 116A and 116B to control the rotational velocity and acceleration of the drive rollers 122A and 122B, respectively. The controller 50 is also operatively connected to the drive roller sensors 118A and 118B to identify the rotational velocity of the drive rollers 122A and 122B, respectively. The controller 50 is operatively connected to the loop box position sensor 36 to receive signals that correspond to the position of the bottom of the media web 32 in the loop box 28.

Figure 2:
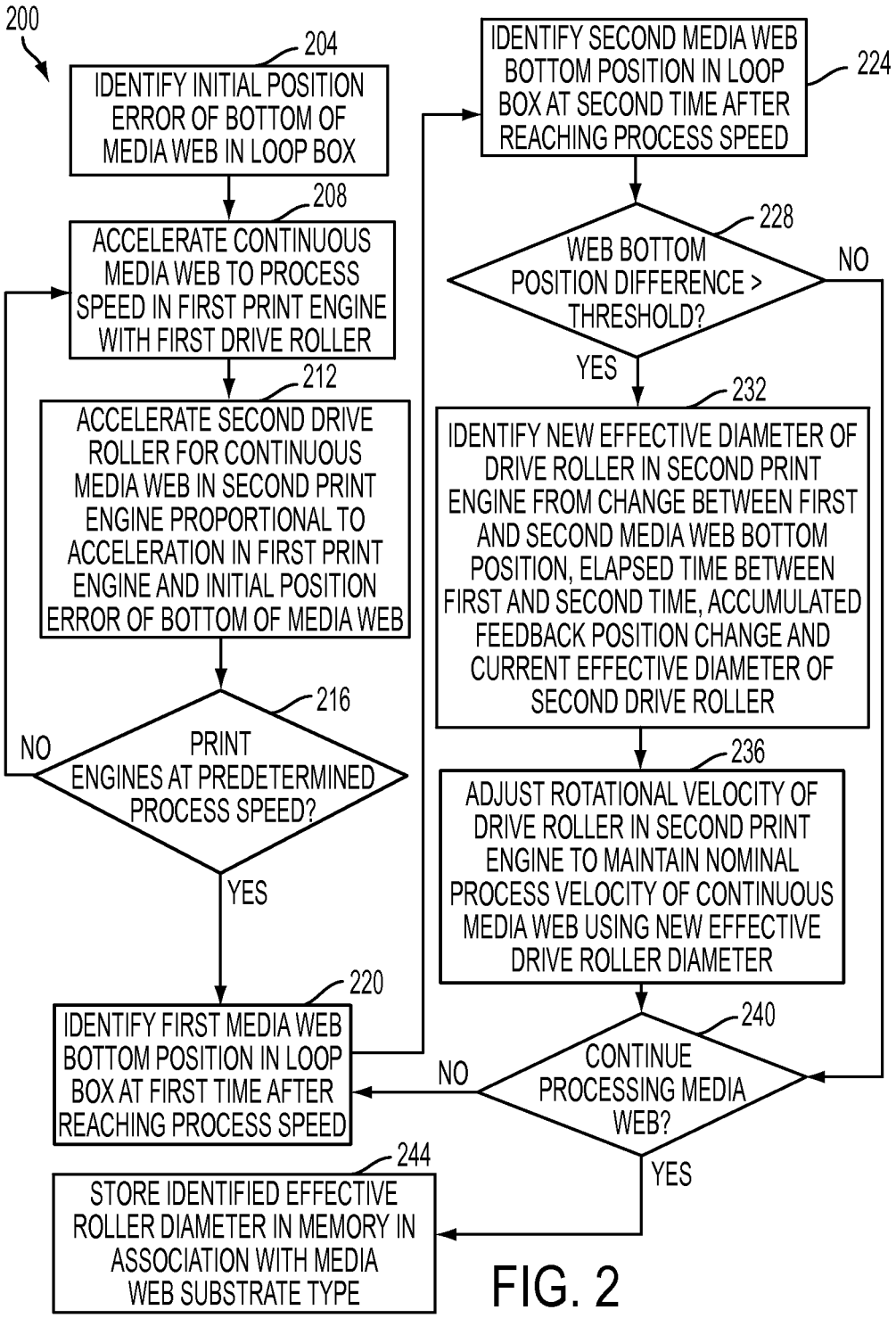
FIG. 2 is a block diagram of a process for estimating effective diameter of the drive roller in one of the print engines of the system of FIG. 1 to maintain a roller in a loop box at a target position.

FIG. 2 depicts a process 200 for the estimation of the effective diameter of the drive roller in a media transport system of a tandem printing system that reduces position error of the bottom of the media web 32 in the loop box 28. In the description below, a reference to the process 200 performing an action or function refers to the execution of stored program instructions by a controller to perform the action or function in conjunction with one or more components in the printing system. While not described in further detail, during both the acceleration and steady state velocity phases of the process 200, either or both of the tandem print engines eject ink drops to form printed images on a media web. Thus, the process 200 occurs during an "online" print job during which the tandem printing system forms printed images on the media web. The process 200 is described in conjunction with the tandem printing system 10 of FIG. 1 for illustrative purposes.

Process 200 begins as the controller 50 identifies an initial position error of a bottom of the media web in a loop box (block 204). As depicted in FIG. 1, the loop box 28 includes the bottom of the media web 32 that moves along the axis 34 during operation. The loop box position sensor 36 generates a signal corresponding to the position of the bottom of the media web 32 in the loop box 28. As depicted in FIG. 1, the position error corresponds to a distance between the bottom of the media web 32 and a predetermined loop target position 42. The error distance is illustrated by the error dimension line 38 in FIG. 1 between the bottom of the media web 32 and the target position 42.

Process 200 continues as a first print engine in the tandem printing system 10 operates a drive roller to accelerate the media web to a predetermined operating velocity at a predetermined rate profile of acceleration (block 208). In one configuration, the "first" print engine is the upstream print engine 100A, although the downstream print engine 100B can be used as the "first" print engine in another configuration. In one configuration, the acceleration begins from an initial rotational velocity of zero rotations per minute (RPM) after the media web 14 is first fed through the media path for the media transport or when the tandem printing system 10 begins from a halted state at zero RPM.

During process 200, the controller 50 controls the rate of acceleration of the second drive roller in a second print engine at a rate that is proportional to the rate of acceleration in the first print engine and the identified initial position error of the bottom of the media web 32 (block 212). In the configuration of FIG. 1, if the upstream print engine 100A is the first print engine, then the downstream print engine 100B is considered to be the second print engine, although in another configuration the upstream print engine 100A is the second print engine and the downstream print engine 100B is the first print engine. In one embodiment, the controller 50 implements a feed-forward proportional controller to control the rate of acceleration for the drive roller in the second print engine. In one embodiment, the controller 50 identifies a gain/coefficient of the proportional feed-forward controller using the following control equation:

$$P_{feedforward} = \frac{v^2}{(v^2 - 2(Acc_1)(V)(T_d) - 4(Acc_1)(LoopError_{initial})}.$$

Where V is the linear velocity of the media web 14 after acceleration to the predetermined operational velocity, $Acc_1$ is the predetermined rate of acceleration in the first print engine, $T_d$ is a predetermined communication time delay between the first print engine and the second print engine, and $LoopError_{initial}$ is the initial position error for the bottom of the media web 32 in the loop box 28. The time delay value $T_d$ is determined empirically for different printing system configurations and is typically in a range of tens of milliseconds, such as 20 ms to 80 ms. In the feed-forward controller, the time delay acts as a noise variable.

While the print engines continue acceleration to a nominal process speed (block 216) the controller 50 continues to accelerate the drive roller in the first print engine at the nominal rate of acceleration and use the feed-forward control process to control the rate of acceleration of the drive roller in the second print engine (blocks 208-212). The feed-forward control strategy used for the second print engine during acceleration of the media web 14 reduces the error in the position of the bottom of the media web 32 in the loop box 28 at the time when the media web 14 reaches a predetermined operational velocity. Reducing the position error of the bottom of the media web 32 in the loop box 28 at the predetermined process speed improves the effectiveness of a feedback control strategy for the loop box and the potential velocity adjustment in the second print engine, so improve the color registration performance and reduces the risk of loop box running out of the range.

Once the drive rollers in the first and second print engines have accelerated the media web 14 to the predetermined process speed (block 216), the controller 50 identifies a first position error of the bottom of the media web 32 at a first time (time A) (block 220) and a second position error of the bottom of the media web 32 at a second time (time B) (block 224) after the media web 14 reaches the process direction velocity. As described above, the controller 50 identifies the position of the bottom of the media web 32 in the loop box 28 using signals that are generated by the loop box position sensor 36. The controller also identifies an elapsed time between the first and second identifications of the position of the bottom of the media web. In one embodiment, the controller 50 identifies the position error for the bottom of the media web 32 at predetermined time intervals (e.g. every 100 seconds). Between time A and B, loop box feedback controller continuous working to bring the bottom of the media web in the loop box close to target by adjusting velocity of the second print engine in a constant sampling rate, The sampling rate for the velocity of the second print engine varies with the different system configuration embodiments, and is approximately 2 seconds in one embodiment.

In some instances, during time A and B, the peak to peak differences for the position of the bottom of the media web 32 are within a predetermined range from the predetermined target position 42. The controller 50 identifies the position error corresponding to the peak to peak distances of the bottom of the media web 32 during the first (time A) and second (time B) times and the predetermined loop target position 42. If the identified peak to peak position difference remains below a predetermined threshold of the target position 42 (block 228), then the process 200 continues during any additional processing of the media web (block 240) and the controller 50 monitors the position of the bottom of the media web 32 during the printing operation without updating the effective diameter of the drive roller. (blocks 220 and 224).

Figure 3:
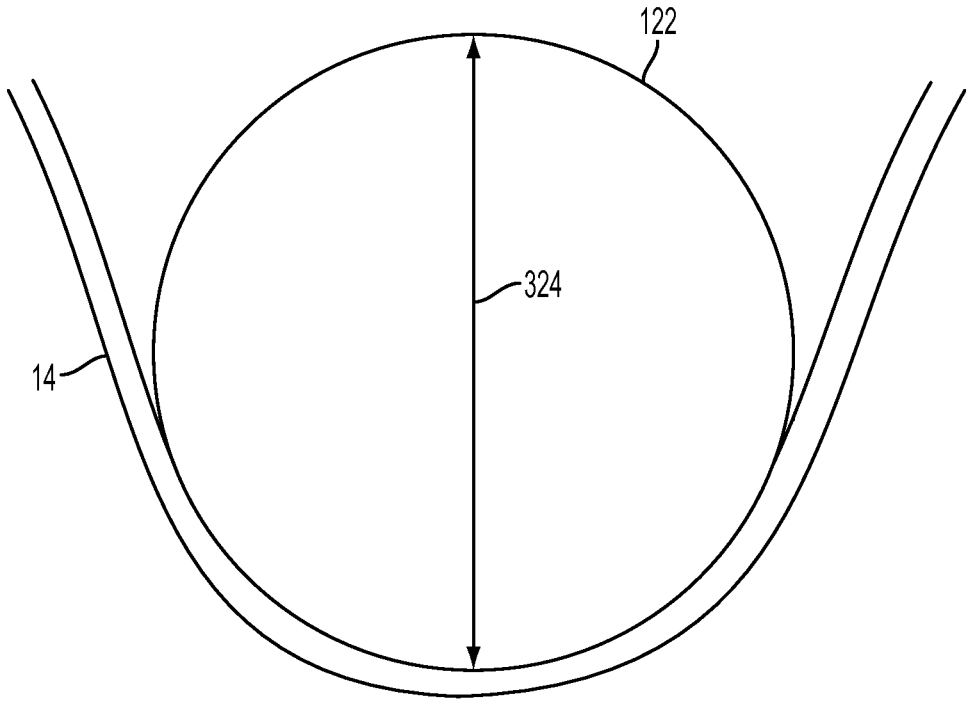
FIG. 3 is a diagram of a drive roller and a portion of a media web that engages the drive roller in a print engine.

If the identified peak to peak position difference of the bottom of the media web 32 exceeds a predetermined threshold (block 228) then the controller 50 produces a new estimate of the effective diameter of the drive roller and then adjusts the rotational velocity of the drive roller in the second print engine to reduce the error of the bottom of the media web 32 (block 232). As used herein, the term "effective diameter" refers to a combined diameter of the drive roller and the media web that engages the drive roller in the second print engine. As depicted in FIG. 3, a drive roller 122 has a predetermined diameter 324. However, during a printing operation the drive roller 122 engages the media web 14, which has a thickness that adds to the effective diameter of the drive roller 122. As depicted in FIG. 3, the media web 14 does not completely encircle the drive roller 122, so the effective diameter of the drive roller 122 is not simply a sum of the nominal diameter 324 and the thickness of the media web 14 on either side of the drive roller 122. Different types of paper that are used in the tandem printing system 10 have different thicknesses that affect the effective diameter of the drive roller 112. Additionally, the effective thickness of paper in a media web can vary over time due to variations in the manufacture of the paper, changes in the degree of stretch that the paper experiences in the media path, and the volume of ink that is placed on the paper during a printing operation.

Referring again to FIG. 2, during the process 200, direct measurement of the thickness of the print medium during operation of the printing system 10 is difficult to perform. Consequently, during process 200 the controller 50 identifies the effective diameter of the drive roller 122 in the second print engine with reference to the change in the position of the bottom of the media web 32 between the first time and the second time, the elapsed time between the first time and the second time, the rotational velocity of the drive roller 122, and the predetermined nominal diameter of the drive roller 122. The controller 50 identifies the effective diameter of the drive roller in the second print engine according the following equations:

$$\Delta D = \frac{120 * \text{Delta_Position} * (D_n)}{\pi(V_{rpm})(D_n)(T_2 - T_1) - 120 * \text{Delta_Position}}$$

$$\text{Delta_Position} = P_2 - P_1 - FB_\text{Position}$$

$$D_{eff} = D_n - \Delta D$$

Where P1 and $P_2$ are the position of the media web bottom 32 in the loop box 28 at two different times $T_1$ and $T_2$, respectively, and FB_Position is the total accumulative position change due to the loop feedback controller between the times $T_1$ and $T_2$. The accumulative position change represents the accumulated change in position that the feedback controller implements to reduce the error between the measured bottom position of the media web 32 and the target position 42 in the loop box 28. The measured position change $P_2$-$P_1$ represents the actual measured change, which may be different than the feedback position change due to additional variations in the media web velocity between the upstream print engine 100A and the downstream print engine 100B. The term $D_1$, is the previously identified effective diameter of the drive roller 122, and $V_{rpm}$ is the current rotational velocity of the drive roller 122 of the second print engine in RPM.

During process 200, the controller 50 implements the loop feedback controller to adjust the rotational velocity of the drive roller in the second print engine using the effective diameter to maintain the velocity of the media web at the predetermined process direction velocity (block 236). As is known in the art, the linear velocity tangential to a drive roller at surface of the drive roller is $V_{linear}=\pi(D_{eff})(V_{rotational})$ where $V_{rotational}$ is the rotational velocity of the drive roller and $D_{eff}$ is the new effective diameter of the drive roller. For example, at a rotational rate of 10 RPM and an effective diameter of 24.7 cm, the linear velocity of the roller is approximately 776 cm/minute. Thus, to maintain a predetermined linear velocity of the media web 14, the controller adjusts the rotational velocity of the drive roller 122:

$$V_{rotational} = \frac{V_{linear}}{\pi D_{eff}}.$$

As the controller 50 adjusts the rotational velocity of the drive roller 122 in the second print engine, the second print engine reduces or eliminates a differential between the linear velocity of the media web 14 in the first print engine and the second print engine. The position error for the bottom of the media web 32 in the loop box 28 decreases as the first and second print engines move the media web 14 at a uniform linear velocity and the bottom of the media web 32 moves towards the target position 42.

Process 200 continues during a print job as the printing system 10 continues to process the media web to form duplex printed images (block 240). The controller 50 continues to monitor the position of the bottom of the media web 32 and adjust the rotational velocity of the drive roller in the second print engine as described above with reference to the processing of blocks 220-236. Once the printing system 10 has finished processing the media web (block 240), the controller 50 stores data for estimation of the effective diameter of the drive roller in the second print engine in the memory 52. The memory 52 stores the effective drive roller diameter for use in subsequent print jobs to improve the accuracy of estimating the effective drive roller diameter for different types of paper used in different media webs.

Figure 4:
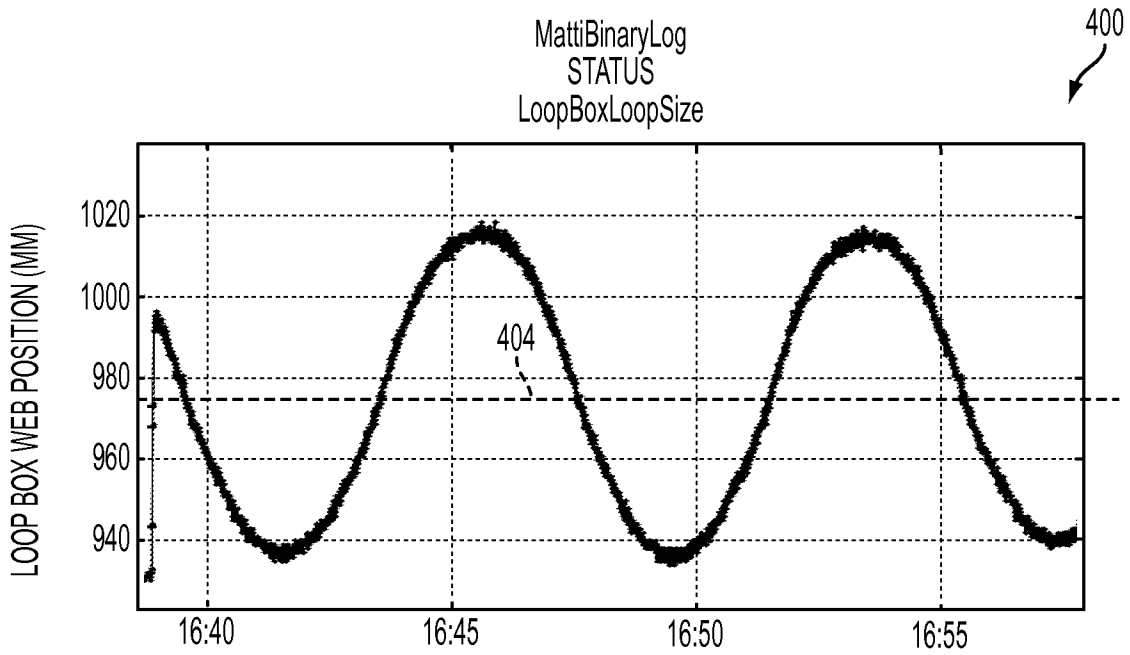
FIG. 4 is a graph of the bottom of the media web movement in a loop box during an embodiment of the process depicted in FIG. 2.
Figure 5:
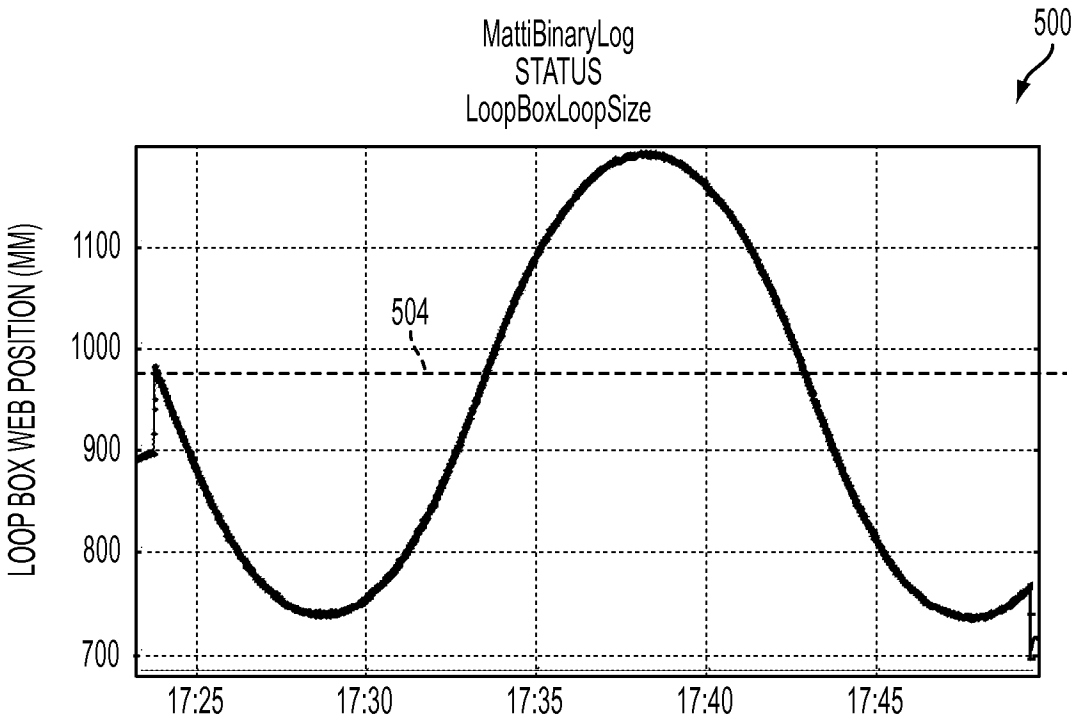
FIG. 5 PRIOR ART
FIG. 5 is a graph of the bottom of the media web movement in a loop box in a prior art printing system.

FIG. 4 depicts a graph 400 that depicts measured variations in the position of the bottom of the media web 32 during process 200. In the graph 400, the line 404 represents the target position 42 of the bottom of the media web 32 in one embodiment of the loop box 28. The variation from the target position is shown in a roughly sinusoidal waveform as the bottom of the media web 32 changes position. The amplitude of movement for the bottom of the media web 32 in the graph 400 is approximately 80 mm. FIG. 5 depicts another graph 500 of the movement of a bottom of the media web in a prior-art printing process that does not include the feed-forward control during print engine acceleration and identification of effective roller diameter that are described in the process 200. In the graph 500, the line 504 depicts the target position for the bottom of the media web. The graph 500 also has a sinusoidal waveform, but the amplitude of movement for the bottom of the media web in the prior art printing system is approximately 430 mm, which is substantially larger than the magnitude of movement that is depicted in FIG. 4 and near the maximum range of movement for some loop box embodiments. The bottom of the media web in the prior art printing system moves much closer to the stop positions for maximum or minimum range, and has a greater chance of being unable to maintain loop position within the predetermined range without causing the printing system to experience a fault that triggers a cycle down process. Thus, the printing system 10 and the process 200 enable operation of a tandem web printing system with improved media velocity and tension control.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating a printer comprising:

operating with a controller at least one actuator operatively connected to a roller in a first print engine, the roller engaging a media web and the at least one actuator rotating the roller at a first rotational velocity to move the media web in a process direction through the first print engine and through a loop box configured to maintain a position of the media web within a predetermined range of positions in the loop box;

identifying with the controller a first position of a bottom of the media web at a first time with reference to a signal from a position sensor operatively connected to the bottom of the media web;

identifying with the controller a second position of the bottom of the media web at a second time occurring after the first time with reference to another signal from the position sensor;

identifying with the controller an elapsed time corresponding to a time period between the first time and the second time;

implementing with the controller a loop feedback controller for adjusting the rotational velocity of the roller;

identifying with the controller a total accumulative position change of the bottom of the media web due to adjustment of the rotational velocity of the roller from the loop feedback controller between the first time and the second time;

identifying with the controller a change in position of the bottom of the media web corresponding to a difference between the second position, the first position, and the total accumulative position change due to the loop feedback controller;

identifying with the controller an effective diameter of the roller that engages the media web with reference to the elapsed time, the change in position of the bottom of the media web, a predetermined diameter of the roller when not in engagement with the media web, and the first rotational velocity of the roller; and operating with the controller the at least one actuator to rotate the roller at a second rotational velocity corresponding to a predetermined linear velocity with reference to the effective diameter of the roller and the loop feedback controller.

2. The method of claim 1, the media web moving in the process direction through the loop box prior to reaching the first print engine.

3. The method of claim 1, the media web moving in the process direction through the loop box after passing through the first print engine.

4. The method of claim 1 wherein the bottom of the media web moves to a third position in response to the rotation of the roller at the second rotational velocity, a distance between the third position of the bottom of the media web and a predetermined target position being less than another distance between the second position and the predetermined target position.

5. The method of claim 1 further comprising:

operating with the controller the at least one actuator to accelerate another roller from a third rotational velocity to the first rotational velocity at a predetermined rate of acceleration, the other roller being in a second print engine that moves the media web in the process direction;

identifying with the controller a third position of the bottom of the media web;

identifying a rate of acceleration for the roller in the first print engine with reference to the predetermined rate of acceleration for the roller in the second print engine, a distance between the third position of the bottom of the media web and a predetermined target position of the bottom of the media web, and the first rotational velocity; and operating with the controller the at least one actuator to accelerate the roller in the first print engine to the first rotational velocity at the identified rate of acceleration.

6. The method of claim 5 wherein the third rotational velocity is zero rotations per minute.

7. The method of claim 5 wherein the second print engine moves the media web in the process direction through the loop box prior to the media web moving through the first print engine.

8. The method of claim 5 wherein the first print engine moves the media web in the process direction through the loop box prior to the media web moving through the second print engine.

9. The method of claim 5, the identification of the rate of acceleration for the roller in the first print engine further comprising identifying the rate of acceleration for the roller in the first print engine using a proportional feed-forward controller with a proportional control corresponding to the predetermined rate of acceleration for the other roller in the second print engine, the distance between the third position of the bottom of the media web and the predetermined target position of the bottom of the media web, and the first rotational velocity.

10. The method of claim 1 further comprising;

storing with the controller data corresponding to the effective diameter of the roller in association with an identifier for the media web in a memory for use in estimating another effective diameter of the roller in a subsequent printing operation.

11. A printing system comprising:

a roller in a first print engine configured to engage a media web;

at least one actuator operatively connected to the roller and configured to rotate the roller to move the media web in a process direction;

a loop box configured to engage the media web to enable a bottom of the media web in the loop box to move between a first position and a second position;

a loop box sensor configured to identify a position of the bottom of the media web in the loop box; and a controller operatively connected to the roller, the at least one actuator, and the loop box sensor, the controller being configured to:

operate the at least one actuator to rotate the roller at a first rotational velocity to move the media web in a process direction through the first print engine and through the loop box;

identify a first position of the bottom of the media web in the loop box at a first time;

identify a second position of the bottom of the media web at a second time occurring after the first time;

identify an elapsed time corresponding to a time period between the first time and the second time;

execute stored program instructions to implement a loop feedback controller for adjusting the rotational velocity of the roller;

identify a total accumulative position change of the bottom of the media web due to adjustment of the rotational velocity of the roller from the loop feedback controller between the first time and the second time;

identify a change in position of the bottom of the media web corresponding to a difference between the second position, the first position, and the total accumulative position change due to the loop feedback control;

identify an effective diameter of the roller that engages the media web with reference to the elapsed time, the change in the position of the bottom of the media web, a predetermined diameter of the roller when not in engagement with the media web, and the first rotational velocity of the roller; and operate the at least one actuator to rotate the roller at a second rotational velocity corresponding to a predetermined linear velocity with reference to the effective diameter of the roller and the loop feedback controller.

12. The printing system of claim 11 wherein the loop box is positioned to enable the media web to move in the process direction through the loop box prior to reaching the first print engine.

13. The printing system of claim 11 wherein the loop box is positioned to enable the media web to move in the process direction through the loop box after passing through the first print engine.

14. The printing system of claim 11 wherein the bottom of the media web moves to a third position in response to the rotation of the roller at the second rotational velocity, a distance between the third position of the bottom of the media web and a predetermined target position being less than another distance between the second position and the predetermined target position.

15. The printing system of claim 11 further comprising:

another roller located in a second print engine and configured to engage the media web to move the media web in the process direction;

the at least one actuator being operatively connected to the other roller and configured to rotate the other roller; and the controller being further configured to:

operate the at least one actuator to accelerate the other roller from a third rotational velocity to the first rotational velocity at a predetermined rate of acceleration;

identify a third position of the bottom of the media web;

identify a rate of acceleration for the roller in the first print engine with reference to the predetermined rate of acceleration for the other roller in the second print engine, a distance between the third position of the bottom of the media web and a predetermined target position of the bottom of the media web, and the first rotational velocity; and operate the at least one actuator to accelerate the roller in the first print engine to the first rotational velocity at the identified rate of acceleration.

16. The printing system of claim 15 wherein the third rotational velocity is zero rotations per minute.

17. The printing system of claim 15 wherein the second print engine moves the media web in the process direction through the loop box prior to the media web moving through the first print engine.

18. The printing system of claim 15 wherein the first print engine moves the media web in the process direction through the loop box prior to the media web moving through the second print engine.

19. The printing system of claim 15, the controller being further configured to:

execute stored program instructions to implement a proportional feed-forward controller to identify the rate of acceleration for the roller in the first print engine corresponding to the predetermined rate of acceleration for the roller in the second print engine, the distance between the third position of the bottom of the media web and the predetermined target position of the bottom of the media web, and the first rotational velocity.

20. The printing system of claim 11 further comprising:

a memory; and the controller being operatively connected to the memory and further configured to:

store data corresponding to the effective diameter of the roller in association with an identifier for the media web in the memory for use in estimating another effective diameter of the roller in a subsequent printing operation.

* * * * *